US008367160B2

(12) United States Patent
Zimmerman

(10) Patent No.: US 8,367,160 B2
(45) Date of Patent: Feb. 5, 2013

(54) COATING METHOD FOR REACTIVE METAL

(75) Inventor: Benjamin Joseph Zimmerman, Enfield, CT (US)

(73) Assignee: United Technologies Corporation, Hartford, CT (US)

( * ) Notice: Subject to any disclaimer, the term of this patent is extended or adjusted under 35 U.S.C. 154(b) by 41 days.

(21) Appl. No.: 12/940,171

(22) Filed: Nov. 5, 2010

(65) Prior Publication Data

US 2012/0114862 A1 May 10, 2012

(51) Int. Cl.
*B05D 3/02* (2006.01)

(52) U.S. Cl. ..... 427/372.2; 427/383.1; 427/383.3; 427/383.7; 427/404; 427/405

(58) Field of Classification Search ..... None
See application file for complete search history.

(56) References Cited

U.S. PATENT DOCUMENTS

| | | | | |
|---|---|---|---|---|
| 154,435 | A | 10/1872 | Adams | |
| 3,542,583 | A | 11/1970 | Small | |
| 3,592,681 | A * | 7/1971 | Hatwell et al. | 427/319 |
| 4,123,594 | A | 10/1978 | Chang | |
| 4,261,742 | A | 4/1981 | Coupland et al. | |
| 4,261,743 | A | 4/1981 | Smith | |
| 4,451,431 | A | 5/1984 | Naik | |
| 4,810,334 | A | 3/1989 | Honey et al. | |
| 4,904,355 | A * | 2/1990 | Takahashi | 205/233 |
| 4,933,239 | A * | 6/1990 | Olson et al. | 428/557 |
| 5,401,307 | A | 3/1995 | Czech et al. | |
| 5,482,578 | A | 1/1996 | Rose et al. | |
| 5,500,252 | A | 3/1996 | Meelu | |
| 5,650,235 | A | 7/1997 | McMordie et al. | |
| 5,688,607 | A | 11/1997 | Rose et al. | |
| 5,833,829 | A | 11/1998 | Foster | |
| 5,989,733 | A | 11/1999 | Warnes et al. | |
| 6,127,047 | A | 10/2000 | Warrell et al. | |
| 6,180,259 | B1 | 1/2001 | Harada et al. | |
| 6,183,888 | B1 | 2/2001 | Alperine et al. | |
| 6,218,029 | B1 | 4/2001 | Rickerby | |
| 6,277,440 | B1 * | 8/2001 | Reynolds | 427/226 |
| 6,291,014 | B1 | 9/2001 | Warnes et al. | |
| 6,296,447 | B1 | 10/2001 | Rigney et al. | |
| 6,299,971 | B1 | 10/2001 | Maloney | |
| 6,306,277 | B1 | 10/2001 | Strangman et al. | |
| 6,376,015 | B1 | 4/2002 | Rickerby | |
| 6,435,830 | B1 | 8/2002 | Allen et al. | |
| 6,455,167 | B1 | 9/2002 | Rigney et al. | |
| 6,458,473 | B1 | 10/2002 | Conner et al. | |
| 6,472,018 | B1 | 10/2002 | Warnes et al. | |
| 6,521,113 | B2 | 2/2003 | Strangman et al. | |
| 6,610,419 | B1 | 8/2003 | Stamm | |
| 6,645,926 | B2 | 11/2003 | Abriles et al. | |
| 6,673,709 | B2 | 1/2004 | Jaslier et al. | |
| 6,974,636 | B2 | 12/2005 | Darolia et al. | |
| 7,229,701 | B2 | 6/2007 | Madhava et al. | |
| 7,357,958 | B2 | 4/2008 | Darolia et al. | |
| 7,604,726 | B2 | 10/2009 | Kozlov et al. | |
| 2002/0132132 | A1 * | 9/2002 | Bose et al. | 428/632 |
| 2005/0079089 | A1 * | 4/2005 | Narita et al. | 420/416 |
| 2010/0108524 | A1 | 5/2010 | van Mol et al. | |
| 2012/0189778 | A1 * | 7/2012 | Riewe et al. | 427/377 |

* cited by examiner

*Primary Examiner* — Erma Cameron
(74) *Attorney, Agent, or Firm* — Carlson, Gaskey & Olds PC

(57) ABSTRACT

A coating method includes depositing a reactive material onto a turbine engine component using an ionic liquid that is a melt of a salt, and heat treating the turbine engine component to react the reactive material with at least one other element to form a protective coating on the turbine engine component.

14 Claims, 1 Drawing Sheet

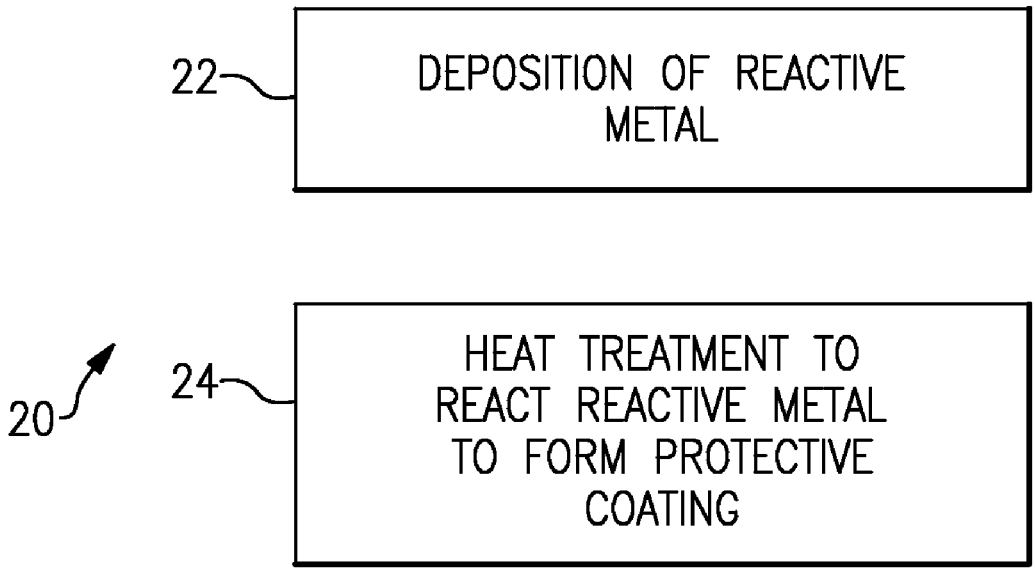
22
DEPOSITION OF REACTIVE METAL
20
24
HEAT TREATMENT TO REACT REACTIVE METAL TO FORM PROTECTIVE COATING

COATING METHOD FOR REACTIVE METAL

BACKGROUND

This disclosure relates to forming protective coatings on articles, such as turbine engine components. Components that operate at high temperatures and under corrosive environments often include protective coatings. As an example, turbine engine components often include ceramic, aluminide, or other types of protective coatings. Chemical vapor deposition is one technique for forming the coating and involves pumping multiple reactive coating species into a chamber. The coating species react or decompose on the components in the chamber to produce the protective coating.

SUMMARY

An example coating method includes depositing a reactive material onto a turbine engine component using an ionic liquid that is a melt of a salt, and heat treating the turbine engine component to react the reactive material with at least one other element to form a protective coating on the turbine engine component.

In another aspect, a coating method includes depositing substantially pure hafnium metal onto a metallic substrate, and heat treating the metallic substrate to react the hafnium metal with at least one other element to form a protective coating on the metallic substrate.

BRIEF DESCRIPTION OF THE DRAWINGS

The various features and advantages of the disclosed examples will become apparent to those skilled in the art from the following detailed description. The drawings that accompany the detailed description can be briefly described as follows.

FIG. 1 illustrates an example coating method for depositing a reactive material.

DETAILED DESCRIPTION OF THE PREFERRED EMBODIMENT

FIG. 1 illustrates selected steps of an example coating method 20 that may be used to fabricate an article with a protective coating, such as a turbine engine component. A few example components are airfoils, vanes or vane doublets, blades, combustor panels, and compressor components. In the illustrated example, the coating method 20 generally includes deposition step 22 and heat treatment step 24. It is to be understood that the deposition step 22 and the heat treatment step 24 may be used in combination with other fabrication processes, techniques, or steps for the particular component that is being coated.

In general, the coating method 20 is used to deposit a reactive material, such as a metal or metalloid from the lanthanide group of elements, scandium metal, yttrium metal, hafnium metal, silicon, zirconium metal, or a combination of these elements. The reactive material may be a substantially pure metal or metalloid that is free of other elements that are present in more than trace amounts as inadvertent impurities. As will be described, the application of the heat treatment step 24 serves to react the metal or metalloid with at least one other element to form a protective coating on the subject component or substrate. In that regard, the other element may be an element from the underlying component, or an element from a neighboring metallic layer that is separately deposited onto the component.

As an example, a user may utilize an ionic liquid that is a melt of a salt to deposit the reactive material onto the component. Unlike electrolytic processes that utilize aqueous solutions to deposit or fabricate coatings, the disclosed coating method 20 utilizes a non-aqueous, ionic liquid for deposition of the reactive material. Thus, at least some metallic elements that cannot be deposited using aqueous techniques or chemical vapor deposition, may be deposited onto the subject component using the ionic fluid. The use of the ionic liquid also provides the ability to coat complex, non-planar surfaces, such as airfoils, with the reactive material.

Using hafnium metal as an example of the reactive material, the ionic liquid may be used to deposit a layer of the hafnium metal onto the surfaces of a subject component, such as a metallic substrate (e.g., superalloy substrate). It is to be understood that the examples herein based on hafnium may be applied to the other reactive material and are not limited to hafnium.

After deposition, the component may be subjected to the heat treatment step 24 at a suitable temperature and time for causing a reaction between the hafnium metal and at least one other element from the alloy of the metallic substrate. The temperature may be 1000°-2000° F. (approximately 538°-1093° C.), in a vacuum atmosphere, for a few hours. For instance, the hafnium may react with nickel or another element from the substrate to form a protective coating on the component.

In another example, after deposition of the hafnium metal and before the heat treatment step 24, a user deposits platinum metal onto the hafnium metal. That is, there are two separate and distinct layers of metals (a hafnium metal layer and a platinum metal layer). The heat treatment step 24 causes a reaction between the hafnium metal and the platinum metal, and possibly other elements from the alloy of the substrate, to form the protective coating.

In another similar example, a user deposits platinum metal directly onto the surfaces of the substrate component prior to the deposition of the hafnium metal. The user then deposits the hafnium metal onto the platinum metal. The heat treatment step 24 causes a reaction between the platinum metal and the hafnium metal, and possibly elements from the alloy of the substrate, to form a protective coating.

In another example, a user deposits the hafnium metal directly onto the substrate component and then platinum metal onto the hafnium metal. The user then deposits additional hafnium metal onto the platinum metal prior to the heat treatment step 24. The heat treatment step 24 causes a reaction between the two layers of hafnium metal and the platinum metal, and possibly elements from the underlying alloy of the substrate, to form the protective coating.

In any of the above examples, the component may additionally be aluminized after the heat treatment step 24 to interdiffuse aluminum metal into the protective coating and cause a reaction therewith to further alter the protective coating as desired. Optionally, in any of the above examples, the coating process may be controlled such that the amount of hafnium or other reactive material in the final protective coating is 10-2000 parts per million.

Although a combination of features is shown in the illustrated examples, not all of them need to be combined to realize the benefits of various embodiments of this disclosure. In other words, a system designed according to an embodiment of this disclosure will not necessarily include all of the features shown in any one of THE FIGURE OR all of the portions schematically shown in the FIGURE. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A coating method comprising:

depositing a reactive material onto a surface of a metallic substrate of a turbine engine component using an ionic liquid that is a melt of a salt; and heat treating the turbine engine component to react the reactive material with at least one other element to form a protective coating on the turbine engine component.

2. The coating method as recited in claim 1, wherein the reactive material is a substantially pure metal or metalloid, that is free of other elements that are present in more than trace amounts as inadvertent impurities.

3. The coating method as recited in claim 1, wherein the reactive material is selected from a group consisting of lanthanide group elements, scandium, yttrium, hafnium, silicon, zirconium, and combinations thereof.

4. The coating method as recited in claim 1, wherein the reactive material is hafnium metal and is present in the protective coating in an amount of 10-2000 parts per million.

5. The coating method as recited in claim 4, wherein the hafnium metal is present in the protective coating in an amount of 10-750 parts per million.

6. The coating method as recited in claim 4, wherein the hafnium metal is present in the protective coating in an amount of 10-500 parts per million.

7. The coating method as recited in claim 1, further comprising depositing platinum metal adjacent to the reactive material such that the heat treating causes the reactive material to react with the platinum metal to form the protective coating.

8. The coating method as recited in claim 1, further comprising aluminizing the turbine engine component after the heat treating.

9. The coating method as recited in claim 1, further comprising depositing platinum metal on the reactive material and then depositing additional reactive material on the platinum metal.

10. The coating method as recited in claim 1, further comprising depositing platinum metal on turbine engine component and then depositing the reactive material on the platinum metal.

11. The coating method as recited in claim 1, wherein the turbine engine component comprises an airfoil.

12. The coating method as recited in claim 1, wherein the reactive material is a metal or metalloid selected from the group consisting of lanthanide group elements.

13. The coating method as recited in claim 1, wherein the reactive material is scandium metal.

14. The coating method as recited in claim 1, wherein the reactive material is yttrium metal.

* * * * *